US010987783B2

(12) United States Patent
Nelson et al.

(10) Patent No.: US 10,987,783 B2
(45) Date of Patent: Apr. 27, 2021

(54) SCREWDRIVER

(71) Applicant: MILWAUKEE ELECTRIC TOOL CORPORATION, Brookfield, WI (US)

(72) Inventors: Collin J. Nelson, Milwaukee, WI (US); Steven W. Hyma, Milwaukee, WI (US); Grant T. Squiers, Cudahy, WI (US); James A. Cemke, Jr., Richfield, WI (US); Abhijeet A. Khangar, Pewaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 356 days.

(21) Appl. No.: 15/924,811

(22) Filed: Mar. 19, 2018

(65) Prior Publication Data

US 2018/0207772 A1 Jul. 26, 2018

Related U.S. Application Data

(63) Continuation of application No. 14/599,072, filed on Jan. 16, 2015, now Pat. No. 9,931,739.
(Continued)

(51) Int. Cl.
*B25B 15/04* (2006.01)
*B25B 15/00* (2006.01)
(Continued)

(52) U.S. Cl.
CPC ..... *B25B 15/04* (2013.01); *B25B 15/00* (2013.01); *B25B 23/12* (2013.01); *B25G 1/085* (2013.01)

(58) Field of Classification Search
CPC ..... B25B 13/463; B25B 15/04; B25B 13/465; B25B 13/468; B25B 13/461; B25B 23/12;
(Continued)

(56) References Cited

U.S. PATENT DOCUMENTS 2,658,766 A 11/1953 Rock
3,667,518 A 6/1972 Stillwagon, Jr.
(Continued)

FOREIGN PATENT DOCUMENTS

EP 1028831 11/2002
EP 1512494 6/2008
(Continued)

*Primary Examiner* — Robert J Scruggs
(74) *Attorney, Agent, or Firm* — Reinhart Boerner Van Deuren s.c.

(57) ABSTRACT

A screwdriver includes a main body and a switch. The main body is coupled to a handle and includes a pair of parallel, spaced apart slots, and a pawl positioned in each slot. Each pawl is biased outwardly by a spring. The switch is pivotable relative to the main body, and the switch includes a groove extending along an arcuate portion of an inner surface. Pivoting the switch in a first direction moves the switch toward a first position in which the groove is positioned in-line with the first pawl. When the switch is in the first position, the first pawl extends outwardly from the slot and engages the internal tooth surface such that application of a torque in a first direction drives a shank in the first direction and application of a torque in the second direction causes the shank to ratchet relative to the main body.

17 Claims, 9 Drawing Sheets

Related U.S. Application Data

(60) Provisional application No. 61/968,611, filed on Mar. 21, 2014, provisional application No. 61/928,243, filed on Jan. 16, 2014.

(51) Int. Cl.
*B25G 1/08* (2006.01)
*B25B 23/12* (2006.01)

(58) Field of Classification Search
CPC ..... B25B 15/00; B25B 15/02; B25B 17/00; B25B 19/00; B25B 23/00; B25G 1/085
See application file for complete search history.

(56) References Cited

U.S. PATENT DOCUMENTS 4,463,788 A 8/1984 Corona et al.
4,480,668 A 11/1984 Lin
4,777,852 A 10/1988 Herman et al.
4,924,733 A 5/1990 McKenzie
4,942,733 A * 7/1990 Hosford ..... F01K 25/005 60/267
5,265,504 A 11/1993 Fruhm
5,341,707 A 8/1994 Bond
5,421,224 A 6/1995 Bond
5,437,212 A * 8/1995 Thompson ..... B25B 13/463 81/63.1
5,535,648 A 7/1996 Braun et al.
5,537,899 A 7/1996 Diedrich
5,570,616 A 11/1996 Thompson et al.
5,579,668 A 12/1996 Kozak
5,595,294 A 1/1997 McKenzie et al.
5,619,891 A 4/1997 Tiede
5,638,727 A 6/1997 Gringer
5,771,760 A 6/1998 Tiede
5,778,743 A 7/1998 Tiede
5,983,757 A 11/1999 Blise et al.
6,029,549 A 2/2000 Baker
6,047,802 A 4/2000 Huang
6,059,083 A 5/2000 Tseng
6,101,901 A 8/2000 Daigle
6,209,422 B1 4/2001 Kamiya et al.
6,250,183 B1 6/2001 Chiang
6,293,173 B1 * 9/2001 Rowlay ..... B25B 15/04 81/177.4
6,332,384 B1 * 12/2001 Cluthe ..... B25G 1/085 81/439
6,349,619 B1 2/2002 Liao
6,370,988 B1 4/2002 Thompson et al.
6,374,711 B2 4/2002 Anderson et al.
6,443,037 B1 * 9/2002 Chang ..... B25B 15/04 81/177.4
6,508,156 B1 * 1/2003 Wei ..... B25G 1/085 81/177.4
6,523,439 B1 2/2003 Huang
6,568,298 B1 5/2003 Zinck
6,568,693 B2 5/2003 Glass
6,575,062 B2 6/2003 Hahn
6,622,597 B2 9/2003 Chen
6,644,147 B1 11/2003 Huang
6,925,912 B2 8/2005 Huang
6,935,211 B2 8/2005 Chen
6,976,409 B2 12/2005 Shu
7,014,023 B1 3/2006 Gauthier
7,021,181 B1 4/2006 Chi
7,028,593 B1 4/2006 Lin et al.
7,036,399 B1 5/2006 Gao et al.
7,044,029 B1 5/2006 Hopper, Jr. et al.
7,080,582 B2 7/2006 Karle
7,086,314 B2 8/2006 Wannop
7,134,368 B2 11/2006 Nagy
7,137,320 B2 11/2006 Tuan-Mu
7,168,342 B2 1/2007 Gao et al.
7,174,810 B1 2/2007 Lin
7,181,997 B1 2/2007 Rinner et al.
7,222,557 B2 5/2007 Li et al.
7,225,708 B2 6/2007 Chen
7,237,459 B1 7/2007 Shiao
7,275,466 B2 10/2007 Cluthe
7,281,455 B2 10/2007 Hu
7,311,186 B2 12/2007 Liao
7,334,509 B1 2/2008 Gao
7,347,127 B2 3/2008 Hu
7,380,482 B1 6/2008 Chan
7,434,493 B2 10/2008 Huang
7,503,104 B2 3/2009 Rinner et al.
D596,473 S 7/2009 McKenzie
7,587,962 B2 9/2009 Marks et al.
7,793,573 B2 9/2010 Gao
7,926,391 B2 4/2011 Hu
7,938,045 B2 5/2011 Itoh
7,950,311 B2 5/2011 Chen
7,954,402 B2 6/2011 Crawford
7,992,472 B2 8/2011 Gao
8,096,214 B2 1/2012 Gao
8,109,182 B2 2/2012 Chen
8,122,791 B2 2/2012 Klomp
D684,836 S 6/2013 Wong
8,453,543 B2 6/2013 Floyd
8,522,651 B2 9/2013 Xu
2006/0065080 A1 3/2006 Davidson et al.
2006/0191381 A1 8/2006 Gao et al.
2007/0000356 A1 1/2007 Staples
2007/0240544 A1 10/2007 Hu
2007/0243763 A1 10/2007 Hu
2008/0092695 A1 4/2008 Hernandez
2008/0276770 A1 11/2008 Blum et al.
2010/0116097 A1 5/2010 Xu
2011/0005358 A1 1/2011 Sun
2011/0296959 A1 12/2011 Kibby
2012/0048068 A1 3/2012 Xu
2013/0055507 A1 * 3/2013 Li ..... B23B 5/167 7/157
2013/0055861 A1 3/2013 Wang
2013/0263706 A1 10/2013 Safar
2013/0333526 A1 12/2013 Chen

FOREIGN PATENT DOCUMENTS

EP 2221147 8/2010
EP 2511048 10/2012
WO 9702927 1/1997
WO 2009010170 1/2009
WO 2009015871 2/2009

* cited by examiner

SCREWDRIVER

CROSS-REFERENCE TO RELATED APPLICATIONS

This application is a continuation of co-pending, prior-filed U.S. patent application Ser. No. 14/599,072, filed Jan. 16, 2015, which claims the benefit of U.S. Provisional Application Ser. No. 61/928,243, filed Jan. 16, 2014, and U.S. Provisional Application Ser. No. 61/968,611, filed Mar. 21, 2014. The entire contents of these documents are incorporated herein by reference.

BACKGROUND

The present invention relates to hand tools and, in particular, to a screwdriver.

Conventional screwdrivers include a handle and a shank portion. The shank portion may include a bore for receiving a removable bit, and the bit may be retained in the bore magnetically. The screwdriver may also include a ratchet mechanism to permit the handle to rotate relative to the shank when a user applies a torque to the handle in one direction.

SUMMARY

In one embodiment, a screwdriver includes a handle, a main body, a first pawl, a second pawl, a shank, a bit, and a switch. The handle includes a first end and a second end and defines an axis therebetween. The main body includes a first portion and a second portion. The first portion is secured within the handle and the second portion includes a pair of slots. The slots are oriented parallel to and spaced apart from one another, and the slots are positioned symmetrically on either side of the axis such that each slot is laterally offset from the axis by an equal distance. The main body further including a spring positioned in each slot. The first pawl is positioned within one of the slots and is biased outwardly from the slot by one of the springs. The first pawl includes a first tooth. The second pawl is positioned within the other of the slots and is biased outwardly from the slot by the other spring. The second pawl includes a second tooth. The shank is coupled to the main body proximate the second portion and includes a first end and second end. The first end has a circular internal tooth surface aligned concentrically with the axis. The internal tooth surface extends circumferentially around a portion of the second body. The second end has a bore. The bit is removably received within the bore of the shank. The switch is positioned between the handle and the shank and is pivotable relative to the main body about the axis. The switch includes an inner surface extending around at least a portion of the first pawl and the second pawl. The switch includes a groove extending along an arcuate portion of the inner surface, and the groove is positioned radially outwardly from the inner surface relative to the axis. Pivoting the switch in a first direction about the axis moves the switch toward a first position in which the groove is positioned in-line with the first pawl. Pivoting the switch in the second direction about the axis opposite the first direction moves the switch toward a second position in which the groove is positioned in-line with the second pawl. When the switch is in the first position, the first pawl extends outwardly from the slot and the first tooth engages the internal tooth surface of the shank such that application of a torque to the handle in a first direction about the axis drives the shank in the first direction. Application of a torque in the second direction about the axis causes the shank to ratchet relative to the main body and handle.

In another embodiment, a screwdriver includes a handle, a main body, a first pawl, a second pawl, a shank, and a switch. The handle includes a first end and a second end and defines an axis therebetween. The handle includes an opening extending from the first end at least partially toward the second end. The main body includes a first portion and a second portion. The first portion is received within the opening of the handle, and the second portion includes a pair of slots oriented parallel to and spaced apart from one another. The slots are positioned symmetrically on either side of the axis such that each slot is laterally offset from the axis by an equal distance. The main body further includes a spring positioned in each slot. The first pawl is positioned within one of the slots and is biased outwardly from the slot by one of the springs. The first pawl includes a first tooth. The second pawl is positioned within the other of the slots and is biased outwardly from the slot by the other spring. The second pawl includes a second tooth. The shank is coupled to the main body proximate the second portion, and the shank includes a first end and second end. The first end has a circular internal tooth surface aligned concentrically with the axis. The internal tooth surface extends circumferentially around a portion of the second body. The second end has a bore configured to receive a bit. The switch is positioned between the handle and the shank and pivotable relative to the main body about the axis. The switch includes an inner surface extending around at least a portion of the first pawl and the second pawl. The switch includes a groove extending along an arcuate portion of the inner surface. The groove is positioned radially outwardly from the inner surface with respect to the axis. The switch is pivotable between a first position, a second position, and a third position between the first position and the second position. The switch is pivoted a maximum distance in a first direction about the axis to move the switch to the first position, and the switch is pivoted a maximum distance in a second direction about the axis opposite the first direction to move the switch to the second position. When the switch is in the first position, the groove is positioned in-line with the slot of the first pawl, thereby permitting the first pawl to extend outwardly such that the first tooth engages the internal tooth surface of the shank. Application of a torque to the handle in a first direction about the axis drives the shank in the first direction while application of a torque in the second direction about the axis causes the shank to ratchet relative to the main body and handle.

In yet another embodiment, a screwdriver includes a handle, a shank, and a bit. The handle includes a first end and a second end, and defines an axis therebetween. The handle includes a body portion proximate the first end and a neck portion positioned adjacent the body portion. The neck portion has a diameter less than a diameter of the body portion. The body portion includes a plurality of holes extending through the body portion parallel to the axis. The holes are angularly spaced apart about the axis, and each hole defines an opening positioned adjacent the neck portion and configured to receive a removable bit. The shank is coupled to the handle and includes a first end and second end. The second end has a bore. The bit is removably received within the bore of the shank.

Other independent aspects of the invention will become apparent by consideration of the detailed description and accompanying drawings.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

DETAILED DESCRIPTION

Figure 1:
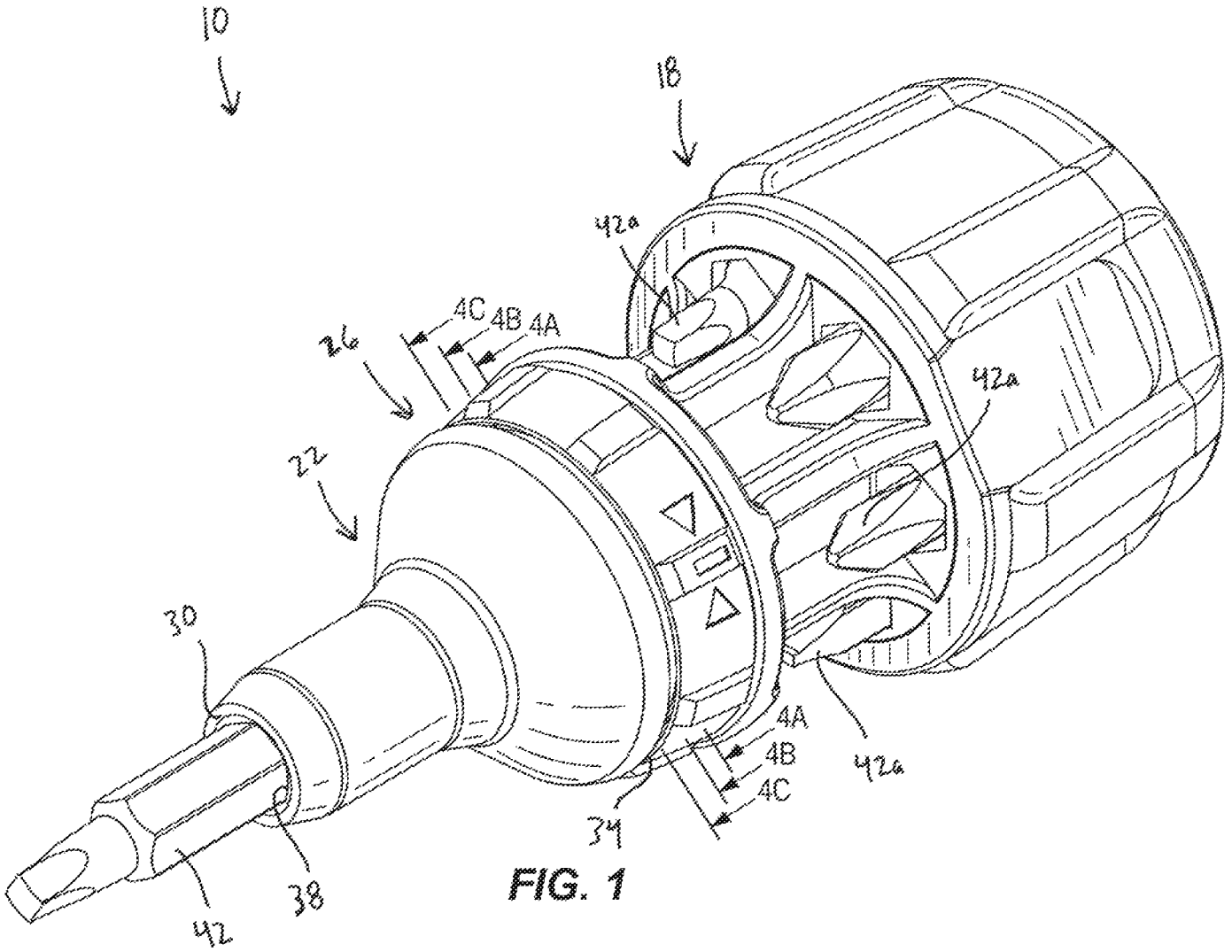
FIG. 1 is a perspective view of a screwdriver.
Figures 2, 3:
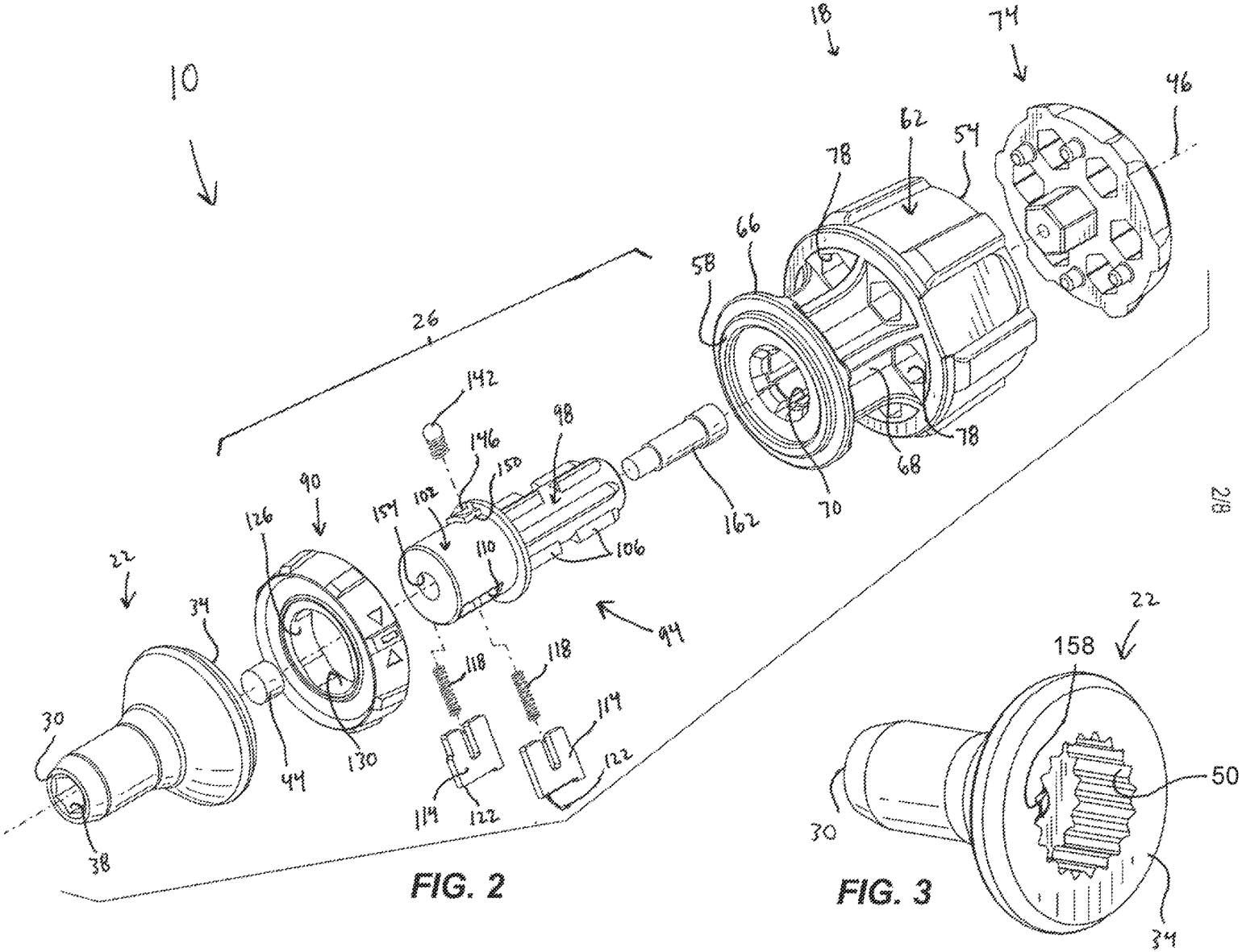
FIG. 2 is an exploded view of the screwdriver of FIG. 1.
FIG. 3 is a perspective view of a shank.

FIGS. 1 and 2 illustrates a screwdriver 10 includes a handle 18, a shank 22, and a ratchet assembly 26. The shank 22 includes a first end 30 and a second end 34. The first end 30 includes a bore 38 that removably supports a bit 42. In one embodiment, the bit 42 is retained within the bore 38 by a magnet 44 (FIG. 2). The second end 34 of the shank 22 includes an internal tooth surface 50 (FIG. 3).

As shown in FIG. 2, the handle 18 includes a first end 54 and a second end 58, and defines a longitudinal axis 46 extending therebetween. In the illustrated embodiment, the handle 18 defines a body portion 62 proximate the first end 54, a rim 66 proximate the second end 58, and a neck portion 68 positioned between the body portion 62 and the rim 66. The neck portion 68 has a smaller diameter than the body portion 62 and the rim 66. The handle 18 further includes an opening 70 extending along the axis 46. A cap 74 is secured to the first end 54 of the handle 18 and closes the opening 70.

FIG. 2 shows that the body portion 62 also includes holes 78 positioned around the axis 46. The holes 78 are oriented parallel to the axis 46 and extend through the body portion 62 and the cap 74. Each hole 78 supports an alternate bit 42*a*, providing convenient storage of the bits 42*a* and permitting easy access to the bits 42*a* when needed. The bit 42 may be removed from the bore 38 of the shank 22 and replaced with one of the alternate bits 42*a*. In the embodiment illustrated in FIG. 1, a working end of each bit 42*a* protrudes from each hole 78 of the body portion 62 and are positioned adjacent the neck portion 68. Since the working ends are exposed, the user can readily identify the type and size of bit 42*a* stored in each hole 78 when the bit 42 needs to be changed.

In the illustrated embodiments, the handle 18 has holes 78 to hold six bits 42*a*; in other embodiments, the handle 18 may include fewer or more holes 78 to store fewer or more bits 42*a*. Also, the illustrated embodiments indicate that the bits 42*a* may be square bits, flat bits, or Philips bits; in other embodiments, the bits 42*a* may have another type or another size. In some embodiments, a grommet is positioned at least partially within each hole 78 to retain each bit 42*a* within a respective hole 78. In the embodiment of FIGS. 1 and 2, the rim 66 prevents the stored bits 42*a* from passing completely through the holes 78 toward the shank 22.

Referring again to FIG. 2, the ratchet assembly 26 includes a selector switch 90 and a mandrel or main body 94. The main body 94 includes a first portion 98 and a second portion 102. The first portion 98 is at least partially received within the opening 70 of the handle 18 and includes multiple radial projections 106 for securing the first portion 98 relative to the inner surface of the opening 70 (e.g., by an interference fit between the projections 106 and the opening 70). The second portion 102 includes two slots 110 (FIGS. 4B and 4C), each of which receives a pawl 114. In the illustrated embodiment, the slots 110 are parallel to one another and offset from the axis 46, and the slots 110 are each spaced from the axis 46 by an equal lateral distance. Each pawl 114 is biased by a spring 118 outwardly from the second portion 102 of the main body 94. An outer surface of each pawl 114 includes a tooth 122 for engaging the internal tooth surface 50 of the shank 22.

In the illustrated embodiment, the switch 90 is formed as a ring extending around a portion of the main body 94. The switch 90 is pivotable about the longitudinal axis 46 relative to the main body 94, and the switch 90 includes an inner wall 126 and a groove 130 formed in the inner wall 126. The groove 130 defines a surface that is spaced farther from the axis 46 than the rest of the inner wall 126. The inner wall 126 also includes three pockets 134 (FIG. 4A) formed separate from the groove 130. In the illustrated embodiment, the switch 90 abuts an end of the shank 22 adjacent the internal tooth surface 50 (FIG. 3). The inner wall 126 engages the pawls 114 to push the pawls 114 into their respective slots 110 against the biasing force of the springs. When the switch 90 is rotated such that the groove 130 is aligned with one of the pawls 114, the aligned pawl 114 slides along an inclined side surface of the groove 130 and extends outwardly from the slot 110. The tooth 122 of the aligned pawl 114 engages the internal tooth surface 50. The handle 18 and main body 94 will ratchet (i.e., rotate relative to the shank 22) in one direction depending on which pawl 114 is extended to engage the internal tooth surface 50.

As shown in FIG. 2, a retention mechanism includes a ball 142 that is positioned within a hole 146 of the second portion 102 of the main body 94. The ball 142 is biased radially outwardly relative to the axis 46. The ball 142 is received within one of the pockets 134 formed in the inner wall 126 of the switch 90. The ball 142 resists unintentional rotation of the switch 90 relative to the main body 94. Also, a protrusion 150 formed around the hole 146 acts as a stop to limit the rotation of the switch 90 in each direction.

In the illustrated embodiment, the main body 94 includes a hole 154 aligned with the axis 46 and extending through the first portion 98 and the second portion 102. The shank 22 also includes a hole 158 (FIG. 3) aligned with the axis 46. A fastener 162 (e.g., a threaded bolt) extends through the hole 154 of the main body 94 and engages the hole 158 of the shank 22, thereby securing the main body 94 relative to the shank 22 and securing the switch 90 between the shank 22 and the main body 94. The magnet 44 is positioned within the hole 158 of the shank 22, between the fastener 162 and the removable bit 42.

Figure 4C:
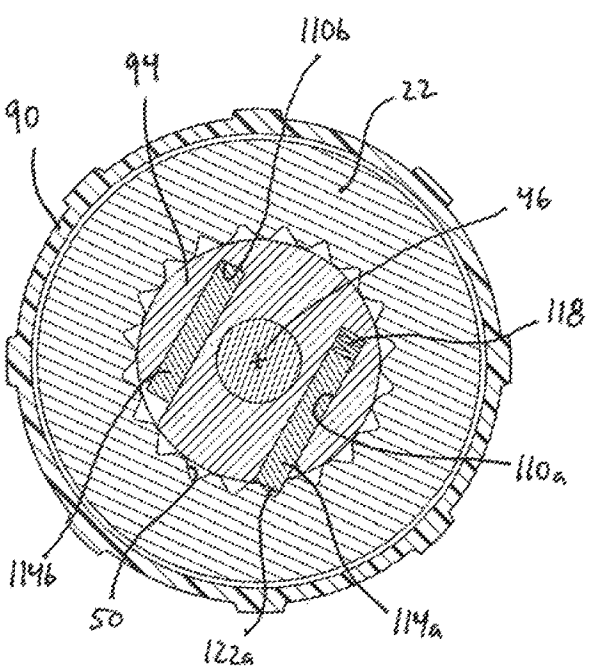
FIG. 4C is a section view of the screwdriver of FIG. 1 viewed along section 4C-4C, with a switch in a first position.
Figure 4B:
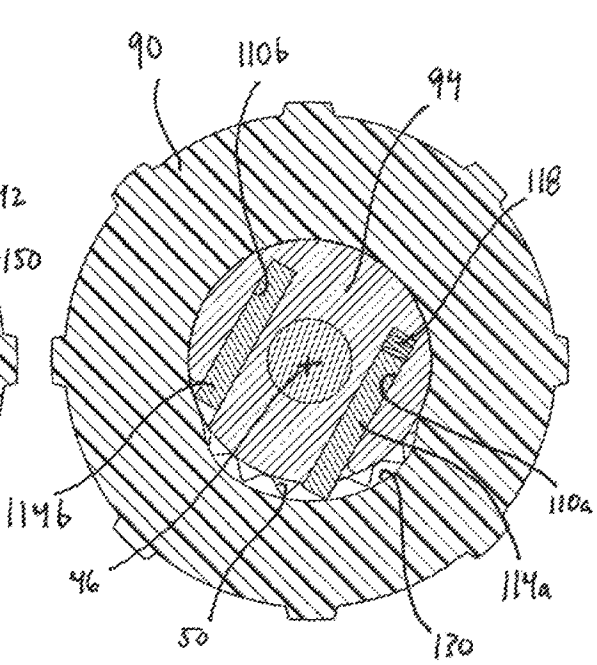
FIG. 4B is a section view of the screwdriver of FIG. 1 viewed along section 4B-4B, with a switch in a first position.
Figure 4A:
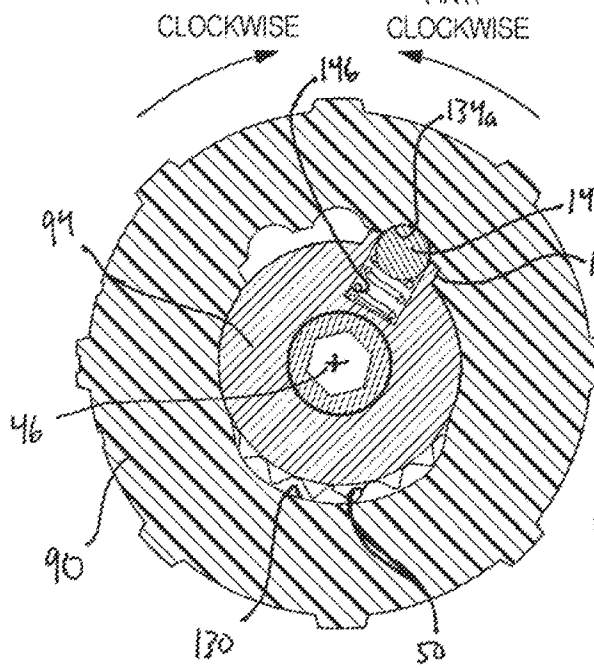
FIG. 4A is a section view of the screwdriver of FIG. 1 viewed along section 4A-4A, with a switch in a first position.

FIGS. 4A-4C illustrate the position of the pawls 114 and ball 142 when the switch 90 is pivoted to a first position. In particular, the switch 90 in FIGS. 4A-4C is pivoted to the furthest extent possible in the anti-clockwise direction relative to the main body 94. In the illustrated embodiment, the protrusion 150 (FIG. 4A) of the main body 94 engages a surface of the switch 90 to prevent further rotation in the anti-clockwise direction. As shown in FIG. 4A, the ball 142 is received within a first pocket 134*a*. As shown in FIGS. 4B and 4C, the switch 90 is positioned such that the groove 130 is in-line with the slot 110 of a first pawl 114*a*. As the switch 90 moves to the first position, the first pawl 114*a* slides along the inclined surface of the groove 130 and extends into the groove 130 due to the spring bias. The pawl 114*a* engages the teeth of the internal tooth surface 50.

In the illustrated position, the main body 94 and handle 18 ratchets or rotate relative to the shank 22 in a clockwise direction when the user applies a clockwise torque on the handle 18 (and therefore the main body 94) sufficient to overcome the biasing force exerted on the extended first pawl 114*a*. Conversely, applying torque in the opposite or driving direction (i.e., anti-clockwise in FIGS. 4A-4C) will cause the internal tooth surface 50 to engage a side of the pawl 114*a* and rotate the shank 22 and bit 42 together with the handle 18. Therefore, the driving direction of the main body 94 complements the rotation direction of the switch 90 since the switch 90 cannot rotate further.

Figures 5A, 5B, 5C:
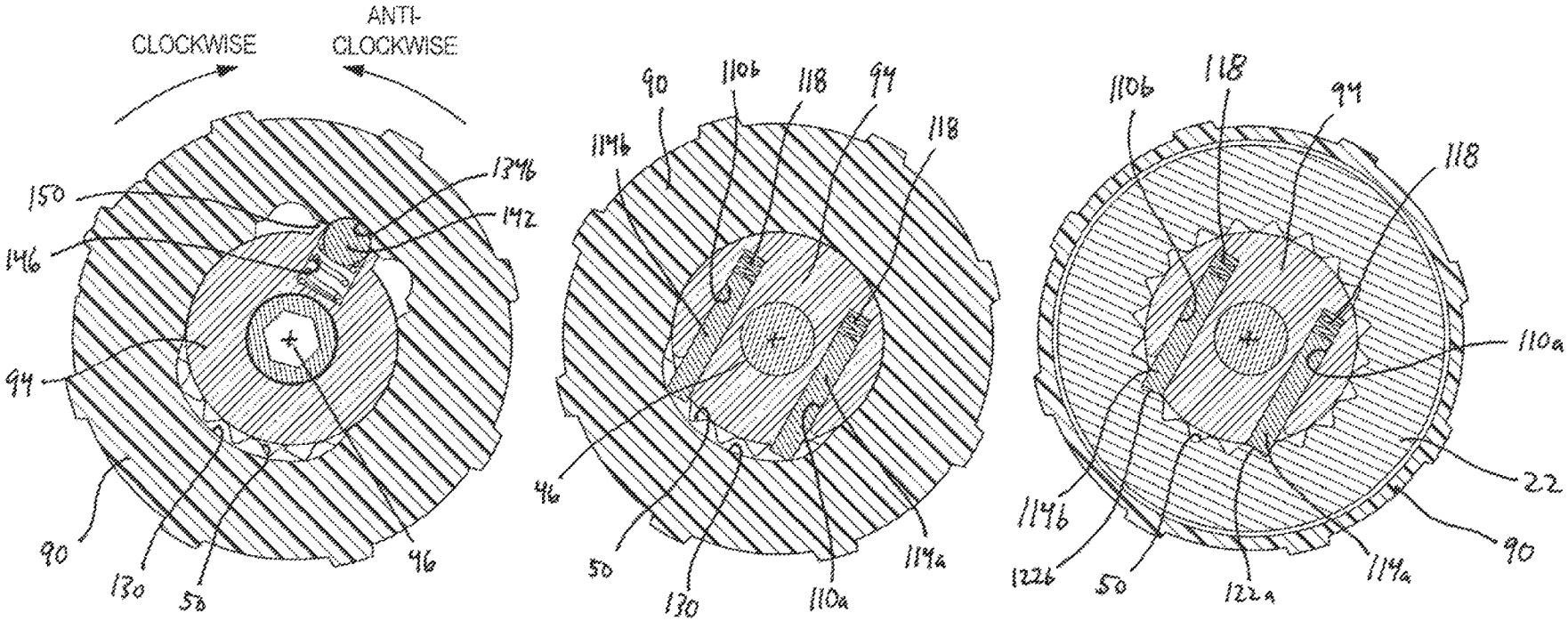
FIG. 5A is a section view of the screwdriver of FIG. 1 viewed along section 4A-4A, with a switch in a second position.
FIG. 5B is a section view of the screwdriver of FIG. 1 viewed along section 4B-4B, with a switch in a second position.
FIG. 5C is a section view of the screwdriver of FIG. 1 viewed along section 4C-4C, with a switch in a second position.

FIGS. 5A-5C illustrate the position of the pawls 114 and the ball 142 when the switch 90 is pivoted to a second position. The switch 90 is in an intermediate position such that the ball 142 is positioned within a second pocket 134*b* and the single groove 130 is in-line with the slots 110 of both pawls 114. Both pawls 114 extend into the groove 130. In this position, applying a torque in either direction will cause the internal tooth surface 50 to catch on a side of one of the pawls 114. Therefore, the main body 94 and the handle 18 will drive the shank 22 to rotate about the axis when a torque is applied to the handle in either direction.

Figure 6C:
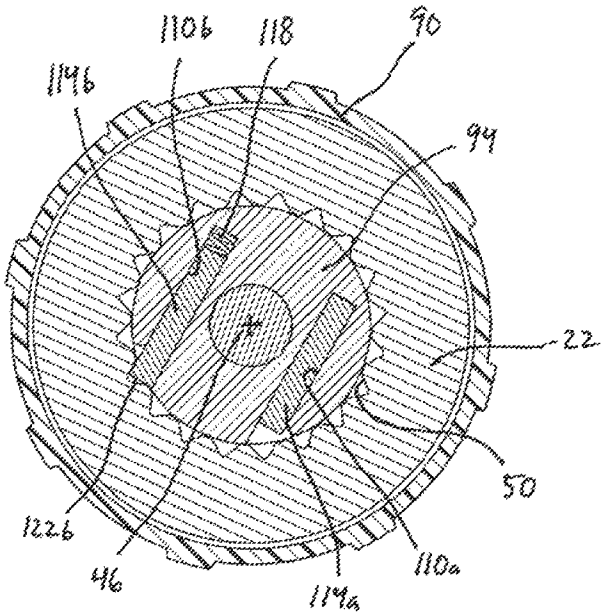
FIG. 6C is a section view of the screwdriver of FIG. 1 viewed along section 4C-4C, with a switch in a third position.
Figure 6B:
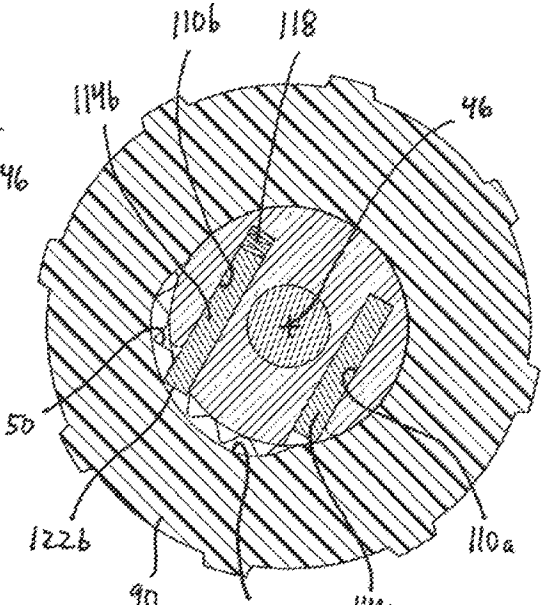
FIG. 6B is a section view of the screwdriver of FIG. 1 viewed along section 4B-4B, with a switch in a third position.
Figure 6A:
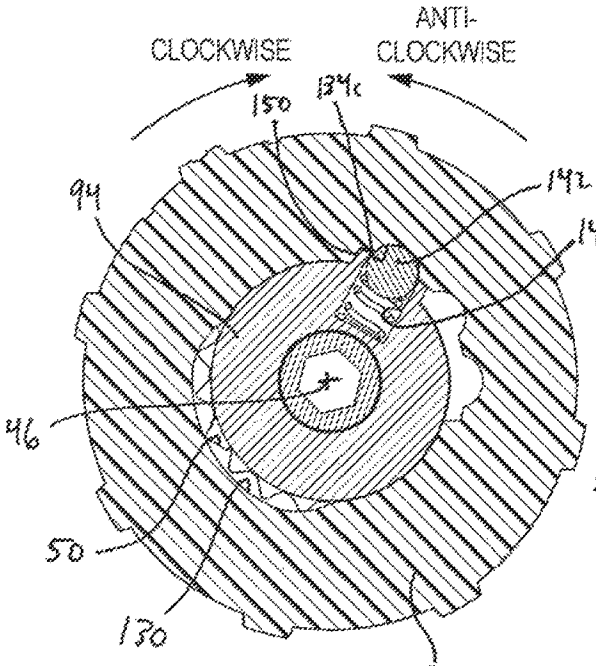
FIG. 6A is a section view of the screwdriver of FIG. 1 viewed along section 4A-4A, with a switch in a third position.

FIGS. 6A-6C illustrate the position of the pawls 114 and the ball 142 when the switch 90 is pivoted to a third position. The switch 90 is pivoted to the furthest extent possible in the clockwise direction relative to the main body 94. In the illustrated embodiment, the protrusion 150 (FIG. 6A) of the main body 94 engages another surface of the switch 90 to prevent further rotation in the clockwise direction. As shown in FIG. 5A, the ball 142 is received within a third pocket 134*c*. As shown in FIGS. 6B and 6C, the switch 90 is positioned such that the groove 130 is in-line with the slot 110 of a second pawl 114*b*. The second pawl 114*b* extends into the groove 130 due to the spring bias and engages the teeth of the internal tooth surface 50.

In the illustrated position, the main body 94 and handle 18 ratchets or rotate relative to the shank 22 in an anti-clockwise direction when the user applies an anti-clockwise torque on the handle 18 sufficient to overcome the biasing force exerted on the extended second pawl 114*b*. Conversely, applying torque in the opposite or driving direction (i.e., clockwise in FIGS. 6A-6C) will cause the internal tooth surface 50 to engage the side of the pawl 114*b* and rotate the shank 22 and bit 42 together with the handle 18. As discussed above with respect to FIGS. 4A-4C, the driving direction of the main body 94 complements the rotation direction of the switch 90 since the switch 90 cannot rotate further.

The ratchet assembly 26 prevents accidental shifting of the switch 90 during use that may occur when the user's fingers slip and apply torque to the switch 90. Since the switch 90 is rotated in the same direction as the driving direction of the shank 22, the user will not accidentally rotate the switch 90 relative to the main body 94. The switch 90 incorporates a single groove that can be aligned with both pawls 114 at the same time.

Figure 7:
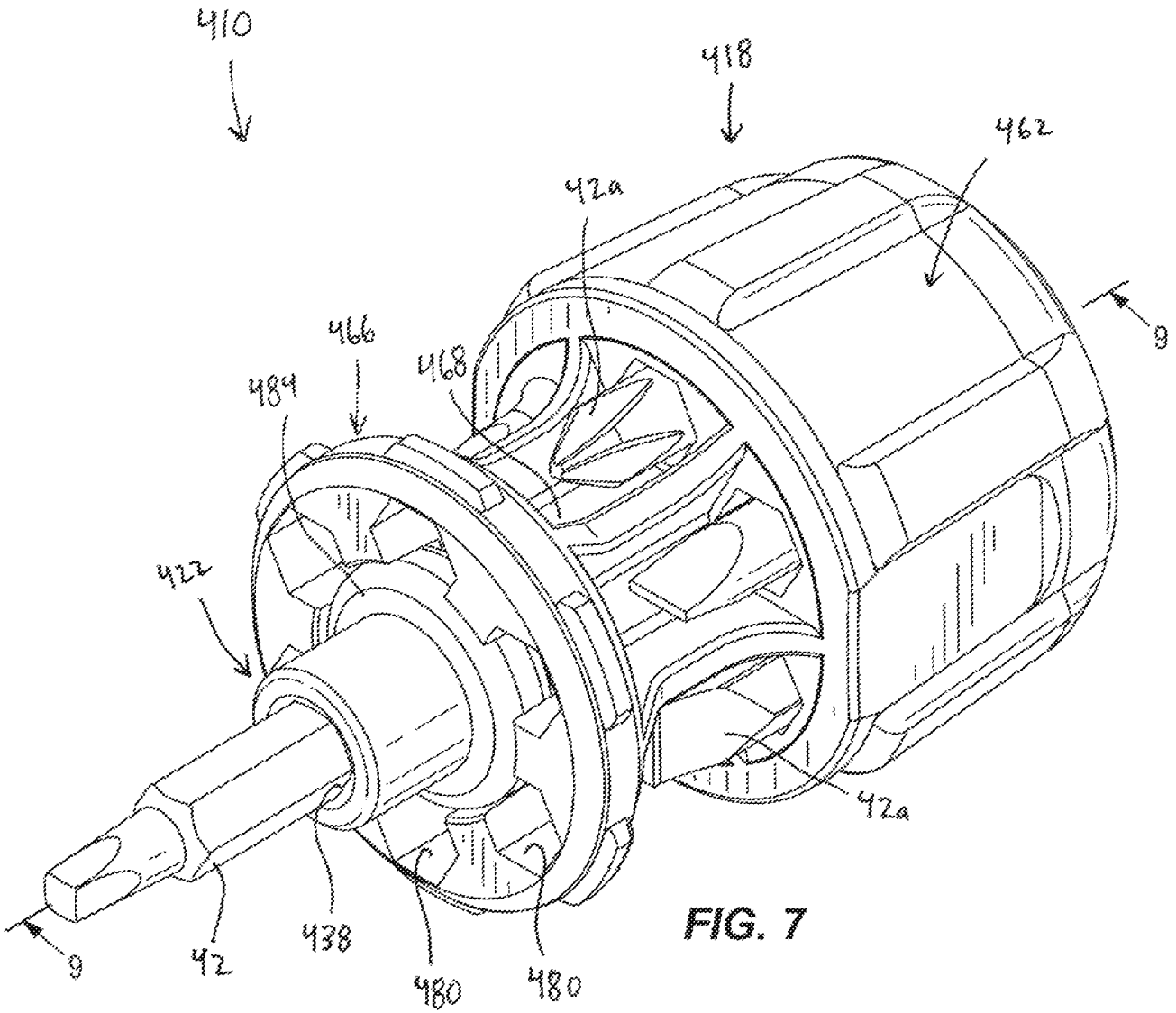
FIG. 7 is a perspective view of a screwdriver according to another embodiment.
Figure 8:
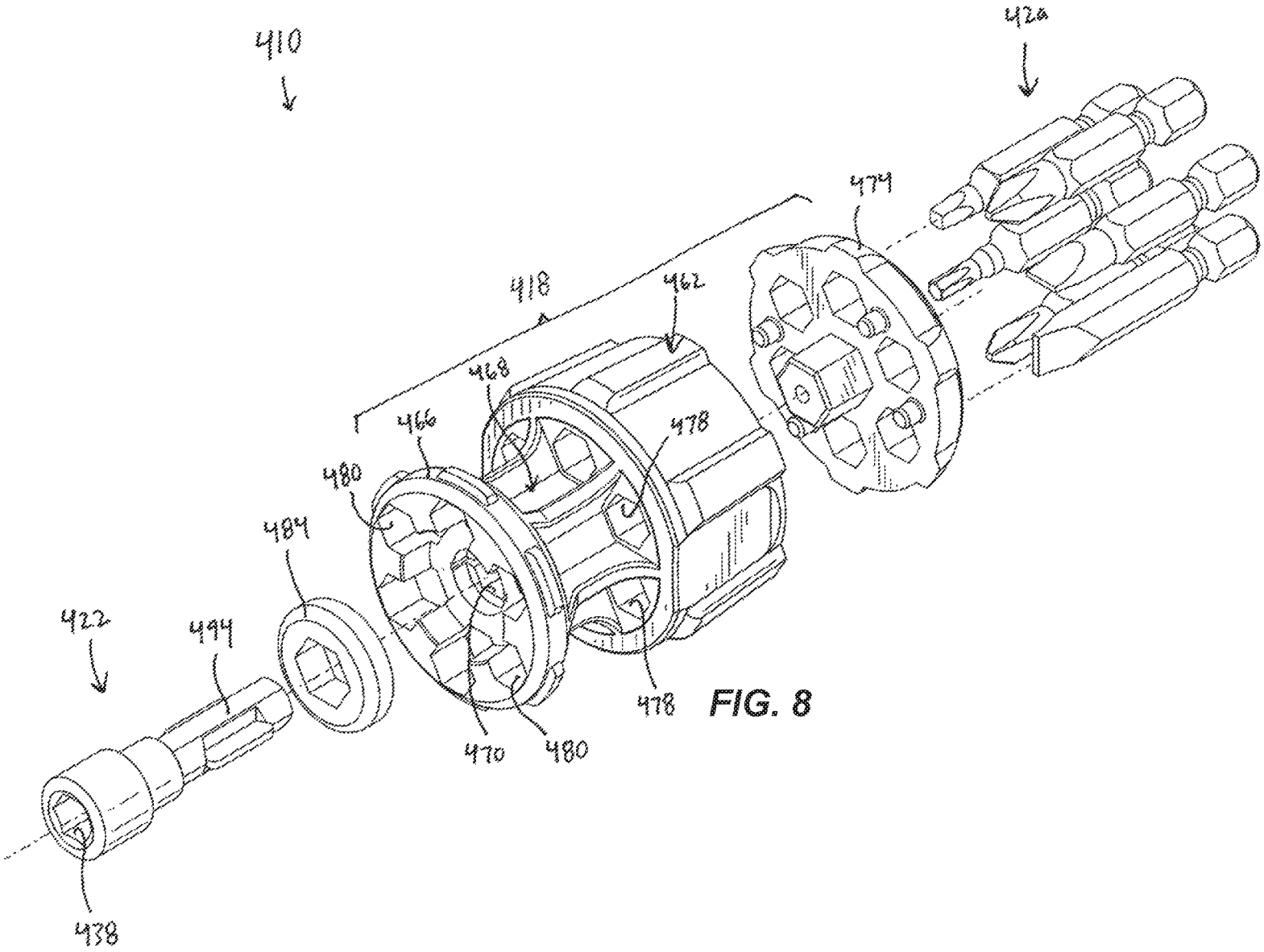
FIG. 8 is an exploded view of the screwdriver of FIG. 7.
Figure 9:
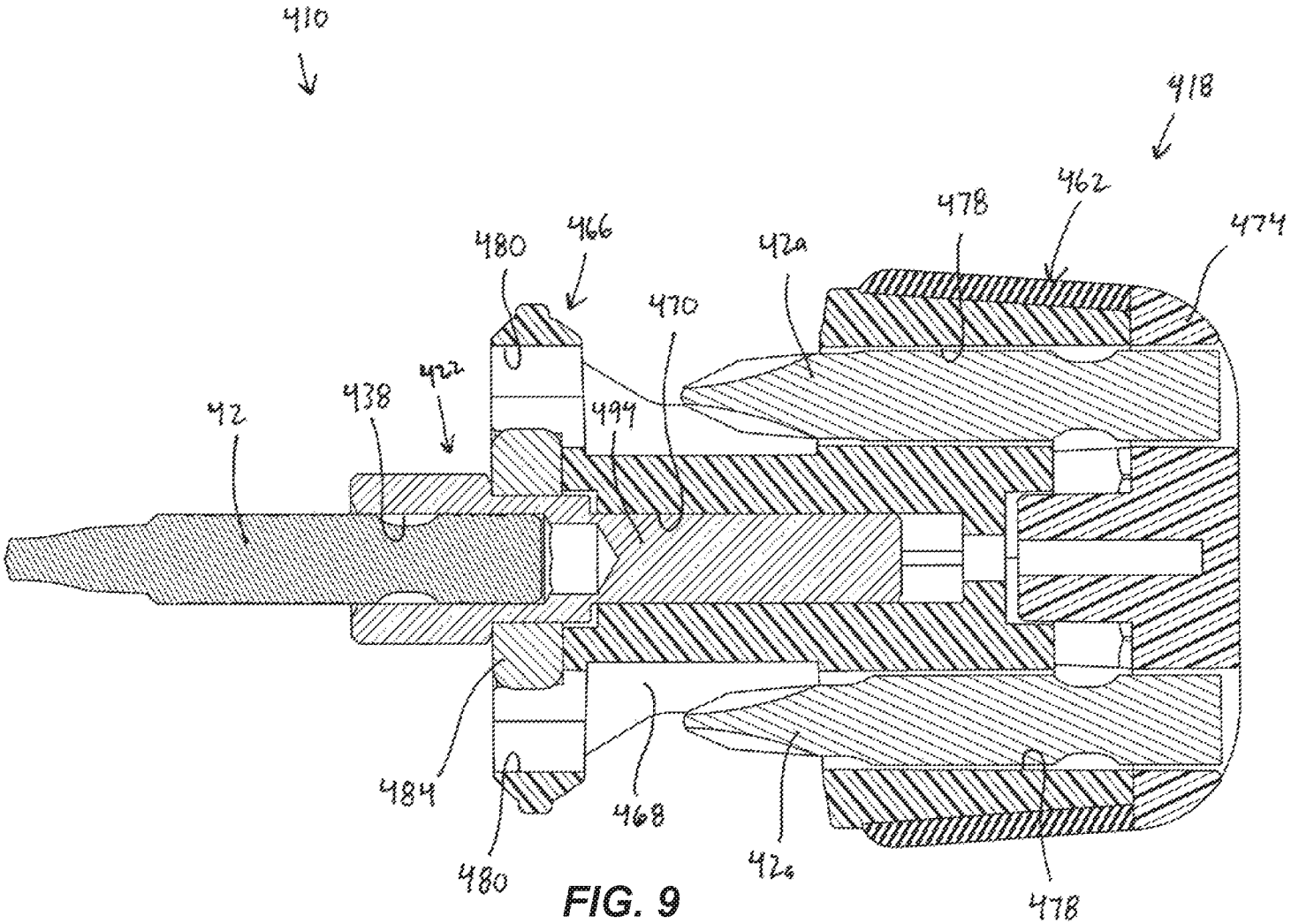
FIG. 9 is a section view of the screwdriver of FIG. 7 viewed along section 7-7.

FIGS. 7-9 illustrate a screwdriver 410 according to another embodiment. For the purposes of brevity, features of the screwdriver 410 that are similar to the features of the screwdriver 10 are referred to by similar reference numbers, plus 400.

The screwdriver 410 includes a handle 418 and a shank 422. The shank 422 is formed integrally with a mandrel 494 (FIGS. 8 and 9) that is secured within an opening 470 (FIGS. 8 and 9) in the handle 418 (e.g., by a press fit). In addition, the handle 418 includes a rim 466 having holes 480 aligned with the holes 478 of the body portion 462, such that the alternate bits 42*a* stored in the holes 478 of the body portion 462 may pass straight through the holes 480 of the rim 466. Thus, the user may remove each bit 42*a* from either the first end 430 or the second end 434 of the handle 418. In some embodiments, the bits 42*a* may be stored such that the bits 42*a* extend between the body portion 462 and the rim 466, such that a central portion of each bit 42*a* is exposed and the user may read the type and size of the bit 42*a* printed on the exposed portion. A grommet 484 is positioned around the shank 422 proximate the rim 466.

Figure 10:
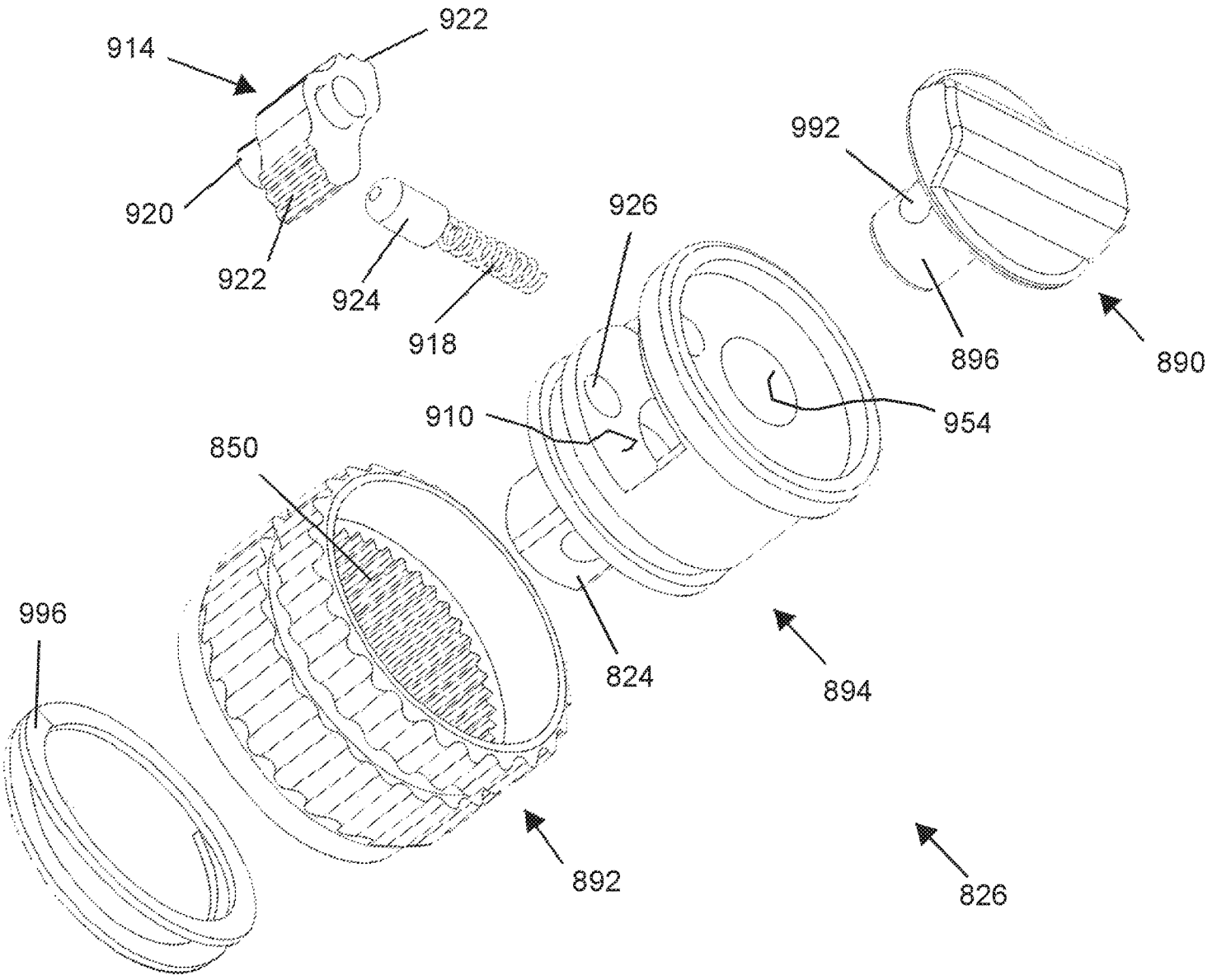
FIG. 10 is an exploded view of a ratchet assembly according to another embodiment.

FIG. 10 illustrates a ratchet assembly 826 according to another embodiment. For the purposes of brevity, features of the ratchet assembly 826 that are similar to the features of the ratchet assembly 26 are referred to by similar reference numbers, plus 800.

The ratchet assembly 826 includes a main body 894, a switch 890, and a gear ring 892 having an internal tooth surface 850. The main body 894 includes a bore 954 and a cutout 910 extending through an arcuate portion of a wall of the main body 894. The cutout 910 includes a hole 926. In the illustrated embodiment, the hole 926 is oriented parallel to the bore 954. The main body also includes a driver 824 configured to engage a shank or a bit (not shown). The main body 894 also includes a pawl member 914 coupled to a pivot pin 920. The pawl member 914 includes two ends, and each end defines a tooth portion 922. The pivot pin 920 is received within the hole 926 of the main body 894 such that the pawl member 914 can pivot about the pivot pin 920 relative to the main body 894. The tooth portions 922 alternately engage the internal tooth surface 850 depending on the position of the pawl member 914. In the illustrated embodiment, a helical washer or spring 996 biases the gear ring 892 into axially to maintain engagement between the gear ring 892 and the main body 894.

The switch 890 includes a protruding pin 896 received within the bore 954 of the main body 894. The pin 896 includes a hole 992 extending perpendicular to the pin 896. When the switch 890 is assembled with the main body 894, the hole 992 is aligned with the cutout 910. A piston 924 is positioned within the hole 992 and is biased outwardly from the hole 992 by a spring 918. The piston 924 is biased into engagement against the pawl member 914. When the switch 890 is rotated to a first position, the piston 924 biases a first tooth portion 922 outwardly to engage the internal tooth surface 850; when the switch 890 is rotated to a second position, the piston 924 biases a second tooth portion 922 outwardly to engage the internal tooth surface 850. In each position, applying a torque on the gear ring 892 in one direction will drive the main body 894 (and therefore also the driver 824) to rotate, while applying a torque to the gear ring 892 in an opposite direction will cause the main body 894 to ratchet or rotate relative to the gear ring 892.

In the embodiment of FIG. 10, the gear ring 892 is secured within a handle (not shown) and the main body 894 is rotatable relative to the gear ring 892. The embodiment of FIG. 10 provides a compact ratchet assembly 826.

Thus, the invention may provide, among other things, a screwdriver. Although the invention has been described in detail with reference to certain independent embodiments, variations and modifications exist within the scope and spirit of one or more independent aspects of the invention as described.

We claim:

1. A screwdriver comprising:

a handle including a first end and a second end and defining an axis therebetween, the handle including a body portion and a neck portion, the neck portion positioned proximate the second end of the handle, the neck portion having a diameter less than a diameter of the body portion, the body portion including a plurality of holes extending through the body portion parallel to the axis, the holes angularly spaced apart about the axis, each of the holes defining an opening positioned adjacent the neck portion;

a shank coupled to the handle, the shank including a first end and second end, the second end having a bore; and a removable bit selectively positionable in the bore of the shank and one of the holes of the body portion;

wherein the handle further includes a rim positioned proximate the second end such that the neck portion is positioned between the rim and the body portion, wherein the diameter of the neck portion is less than a diameter of the rim;

wherein each of the holes of the body portion is configured to support the removable bit such that a working end of the removable bit is positioned below the rim and along the neck portion such that the working end of the removable bit is visible within a space between the body portion and the rim when viewed from a lateral side of the handle.

2. The screwdriver of claim 1, wherein the rim includes a plurality of holes aligned with the holes of the body portion such that the removable bit can pass through one hole of the plurality of holes in the body portion through a respective hole in the rim.

3. The screwdriver of claim 1, further comprising a ratchet assembly including a first end secured relative to the handle and a second end coupled to the first end of the shank such that the ratchet assembly is located between the rim and the shank.

4. The screwdriver of claim 1, wherein the handle includes a bore extending at least partially along the axis and defining an opening proximate the second end, wherein the first end of the shank is secured within the bore of the handle.

5. The screwdriver of claim 1, further comprising a cap positioned adjacent the first end of the handle and removably coupled to the body portion to selectively cover one end of each of the holes of the body portion.

6. The screwdriver of claim 1, further comprising a ratchet assembly including a first end secured relative to the handle and a second end coupled to the first end of the shank.

7. The screwdriver of claim 1, further comprising a cap coupled to the first end of the handle, the cap including a plurality of holes extending through the cap and each aligned with one of the plurality of holes of the body portion.

8. A screwdriver comprising:

a handle including a first end and a second end and defining an axis therebetween, the handle including a body portion, a rim positioned proximate the second end, and a neck portion positioned between the rim and the body portion, the neck portion having a diameter less than a diameter of the body portion and less than a diameter of the rim, the body portion including a plurality of holes extending through the body portion parallel to the axis, the holes angularly spaced apart about the axis, each of the holes defining an opening positioned adjacent the neck portion;

a shank coupled to the handle, the shank including a first end, a second end, and a bore positioned proximate the second end of the shank;

a ratchet assembly including a first end coupled to the rim of the handle and a second end coupled to the first end of the shank such that the ratchet assembly is located between the rim and the shank; and a removable bit selectively positionable in the bore of the shank and one of the holes of the body portion.

9. The screwdriver of claim 8, wherein the rim includes a plurality of holes aligned with the holes of the body portion such that the removable bit can pass through the one hole in the body portion through a respective hole in the rim.

10. The screwdriver of claim 8, wherein each of the holes of the body portion is configured to support the removable bit such that a working end of the removable bit is positioned adjacent the neck portion and is visible within a space between the body portion and the rim.

11. The screwdriver of claim 8, wherein the handle includes a bore extending at least partially along the axis and defining an opening proximate the second end, wherein the first end of the shank is secured within the bore of the handle.

12. The screwdriver of claim 8, further comprising a cap positioned adjacent the first end of the handle and removably coupled to the body portion to selectively cover an end of each of the holes extending through the body portion.

13. The screwdriver of claim 8, further comprising a cap coupled to the first end of the handle, the cap including a plurality of holes extending through the cap and each aligned with one of the plurality of holes of the body portion.

14. A screwdriver comprising:

a handle including a first end and a second end and defining an axis therebetween, the handle including a body portion and a neck portion, the neck portion positioned proximate the second end of the handle, the neck portion having a diameter less than a diameter of the body portion, the body portion including a plurality of holes extending through the body portion parallel to the axis, the holes angularly spaced apart about the axis, each of the holes defining an opening positioned adjacent the neck portion;

a cap coupled to the first end of the handle, the cap including a plurality of holes extending through the cap and each aligned with one of the plurality of holes of the body portion;

a shank coupled to the handle, the shank including a first end and second end, the second end having a bore;

a ratchet assembly including a first end coupled to the handle and a second end coupled to the first end of the shank such that the ratchet assembly is located between the neck and the shank; and a removable bit selectively positionable in the bore of the shank and one of the holes of the body portion.

15. The screwdriver of claim 14, wherein the handle further includes a rim positioned proximate the second end such that the neck portion is positioned between the rim and the body portion.

16. The screwdriver of claim 15, wherein the rim includes a plurality of holes aligned with the holes of the body portion such that the removable bit can pass through the one hole in the body portion through a respective hole in the rim.

17. The screwdriver of claim 15, wherein each of the holes of the body portion is configured to support the removable bit such that a working end of the removable bit is positioned adjacent the neck portion and is visible within a space between the body portion and the rim.

* * * * *